US005775384A

United States Patent [19]

Alvern

[11] Patent Number: 5,775,384

[45] Date of Patent: Jul. 7, 1998

[54] FLUID FILLER GUN HAVING A PIVOTABLE GUN BARREL

[75] Inventor: Øyvind Alvern, Hjellestad, Norway

[73] Assignee: Alvern-Norway A/S, Oslo, Norway

[21] Appl. No.: 803,452

[22] Filed: Feb. 20, 1997

[51] Int. Cl.[6] ..... B65B 1/04

[52] U.S. Cl. ..... 141/59; 141/206; 141/392

[58] Field of Search ..... 141/392, 59, 206–226; 239/587.4; 285/261

[56] References Cited

U.S. PATENT DOCUMENTS

| | | | |
|---|---|---|---|
| 3,334,818 | 8/1967 | Moen | 239/587.4 |
| 3,929,175 | 12/1975 | Coone | 141/392 |
| 3,955,763 | 5/1976 | Pyle et al. | 285/261 |
| 4,394,969 | 7/1983 | Jette | 239/587.4 |
| 4,776,615 | 10/1988 | Young | 285/261 |
| 5,197,523 | 3/1993 | Fink, Jr. et al. | 141/206 |

*Primary Examiner*—Henry J. Recla
*Assistant Examiner*—Steven O. Douglas
*Attorney, Agent, or Firm*—Finnegan, Henderson, Farabow, Garrett & Dunner, L.L.P.

[57] ABSTRACT

A fluid filler gun for delivering fluid into a fluid tank, the fluid filler gun having a pivotable gun barrel. The gun barrel pivots relative to the gun head about a ball joint. The connection of the gun barrel with the gun head comprises a ball with a fluid flow conduit therethrough, where one end of the flow conduit is connected to the fluid outlet of an actuating valve in the gun head, and the other end of the flow conduit opens towards a fluid conduit in the gun barrel. A carrier element for the gun barrel fluid conduit is shaped on the inside substantially complementary to the ball and at least partially encompasses the ball with a spacing therebetween, allowing rotatable movement of the carrier element about the ball. The carrier element has a fluid flow conduit communicating with the flow conduit in the ball, and the fluid flow conduit of the gun barrel is connected to the outlet of the fluid flow conduit of the carrier element.

29 Claims, 3 Drawing Sheets

FLUID FILLER GUN HAVING A PIVOTABLE GUN BARREL

BACKGROUND OF THE INVENTION

1. Field of the Invention

The present invention relates to a fluid filler gun. More particularly, the invention relates to a fluid filler gun having a pivotable gun barrel used for dispensing fluid into a vehicle fluid tank and may include an apparatus for removing escaping fluid vapor during filling of the fluid tank, to prevent these fluid vapors from escaping into the atmosphere.

2. Description of the Related Art

Existing fluid filler guns, used e.g., for pumping fuel or other fluids into a vehicle, such as a car, a boat, a motorcycle, an airplane, or the like, typically have rigid gun barrels. Occasionally, the operator is unable to fit the gun barrel neatly into the vehicle fuel tank opening. The fueling process often is conducted with the gun barrel inserted at an acute angle to the fuel tank opening, creating a risk of spilling some or all of the fuel. This may lead to a potential fire hazard, and has a negative impact on the environment. Moreover, fuel is often spilled both on the vehicle and on the operator.

For example, the vehicle often cannot be parked as close to the fuel pump as required, or it may be parked at an acute angle to the fuel pump. Because of this angle, the operator has to use force in order to fit the gun barrel into the opening of the fuel tank. Quite often, this situation results in the gun barrel being inserted at such an angle that the full length of the gun barrel is not inserted into the opening of the fuel tank. Refueling under these conditions can lead to a fuel spill or a possible fire.

A rigid gun barrel is also prone to damage if it is dropped to the ground or otherwise subjected to forces for which it is not designed. This can lead to a fuel spill, and also may render the filler gun inoperative. The latter condition is inconvenient to the user and leads to downtime and a potential loss of income to the fuel station owner.

A previous "non-rigid" fuel barrel comprises a fuel dispensing nozzle for dispensing hydrocarbon fuel, having a hinged nozzle with a valve which permits or stops the flow of a fuel as the gun barrel is moved relative to the gun head. This movement, however, includes only one degree of freedom and the hinged barrel does not provide much help to the operator when he attempts to insert the barrel into the opening of a vehicle tank at an acute angle. Also the valve system limits the operator to a narrow range in which the filler tube can be pivoted without stopping the flow of fuel.

A magnetically latchable liquid dispensing nozzle has been attempted, which includes a nozzle that can be magnetically latched to a fluid tank filling pipe. The nozzle generally consists of two parts, a rear part with the handle of the nozzle connected at its rearmost extremity to a typical fuel dispensing hose, and a forward part that is pivotable about an axis, allowing pivotable movements of the spout, for insertion into the filling pipe of the vehicle fuel tank. Movement of this device is restricted to only one degree of freedom, and the device has most of the same restrictions as the previously mentioned apparatus, in that it does not provide much help to the operator trying to insert the barrel into the filling tube of a vehicle tank at an acute angle.

Another related device is directed to a fuel dispensing filler gun and an inlet hose pivotably jointed in the transition between the hose and the filler gun. This pivotable joint allows movement with two degrees of freedom. However, the complete filler gun must be moved relative to the hose, and in a restricted space, the operator may not have enough room to fit the barrel into the filling pipe of the fuel tank.

SUMMARY OF THE INVENTION

It is an object of the present invention to provide a fluid filler gun capable of easy insertion of the gun barrel into an opening of a vehicle fluid tank. The gun barrel can move relative to the gun head both sideways and up and down for entering the fluid tank opening. By allowing the barrel to move with reference to the gun head, the operator can easily insert the barrel into the fluid tank opening, and once entered, the barrel position can be adjusted to fit fully and safely into the opening before the filling process commences.

The present invention overcomes problems with conventional filler guns by allowing the barrel to be easily inserted even though the filler gun and the fluid tank filler opening are not aligned.

Furthermore, by rendering the gun barrel pivotable, the filler gun is better protected if it is dropped onto the ground. A pivotable gun barrel will flex when the filler gun hits the ground, thus reducing the force of impact.

The present invention provides a fluid filler gun having a flexible connection between the gun barrel and gun head, and furthermore a flexible seal in the connection, reducing the risk of unwanted fluid spill or breakage due to a blow or an impact to the barrel or gun head.

The filler gun with the pivotable gun barrel may be used to dispense fuel into a fuel tank of a car, a motorcycle, an airplane, a boat, or a single fuel tank for use e.g., as a container of extra fuel. The fuel may be diesel, gasoline, liquefied natural gas (LNG), liquefied petroleum gas (LPG), or any other type of hydrocarbon-based fuel.

The filler gun may further be used for dispensing other liquid or gaseous media such as engine lubricants, transmission lubricants, servo-liquids, vehicle window cleaning fluids, or other cleaning liquids or coolants.

The fluid dispensing system of the invention also is designed to meet future restrictions on air pollution. The pivotable gun barrel of the present invention allows movement with two degrees of freedom without inflicting restrictions with respect to the design solutions for reducing the escape of vapor fluid. Current air pollution abatement programs contemplate specifying that during the refueling process of automobiles and other vehicles, the displaced vapors which are generated as the tanks are filled are to be recovered, such as by directing them to an on-board vehicle system to be consumed, or by returning them through the nozzle of the gun barrel to the supply tank. It is an object of the present invention to allow for escaping vapor fluid to be evacuated without reducing filler gun flexibility, and without introducing a separate system to the fluid filler gun that would render it less flexible and more difficult to insert properly into the tank opening.

Related solutions work adequately in some respects, but do not provide the flexibility and versatility of the present invention, which results in a safe and reliable insertion of the gun barrel into the fluid tank opening, reducing spill of fluid onto the ground, the exterior of the tank, the associated vehicle, and the operator.

The objects of the present invention are fulfilled by providing a fluid filler gun for delivering fluid into a fluid tank, including a filler gun comprising, in series, a gun handle, a gun head, and a gun barrel, wherein said gun barrel is pivotably connected to said gun head by a ball joint, the ball joint having a fluid conduit connecting an inlet of a fluid conduit of the gun barrel to an outlet of an actuating fluid valve in the gun head.

The connection of the gun barrel with the gun head comprises a ball with a fluid flow conduit therethrough, wherein one end of the flow conduit is connected to the fluid outlet of the actuating fluid valve of the gun head, and the other end of the flow conduit opens towards the fluid conduit of the gun barrel, and a carrier element for the gun barrel fluid conduit. The inside of the carrier element is shaped substantially complementary to the ball and at least partially encompasses the ball with a spacing therebetween, allowing rotatable movement of the carrier element about the ball. The outside of the carrier element is shaped complementary to the inside of a housing portion of the gun head. The carrier element has a fluid flow conduit communicating with the flow conduit in the ball, and the fluid flow conduit of the gun barrel is connected to the outlet of the fluid flow conduit of the carrier element.

The filler gun may have a flexible sealing element e.g., an O-ring, located in the spacing between the ball and the carrier element, to prevent fluid backflow to the interior of the gun head.

The gun barrel may be autoalignable with the gun head by means of a helical spring coaxially mounted about the gun barrel to keep the barrel in substantial alignment with the gun head. Such alignment is considered to be the ideal position for most tank filling operations.

The barrel and the spring may be encompassed by a flexible bellow to further protect the gun fluid conduit from damage if the filler gun is dropped onto the ground or receives other impacts.

The present invention provides full fluid flow at all times with the gun barrel capable of pivoting about two axes within wide angular boundaries.

The gun barrel may be configured to have restricted movement relative to the gun head in an angular direction, as this may be suitable for some embodiments. The gun barrel furthermore may be provided with a device to prevent twisting of the gun barrel relative to the gun head. The restrictive device may be a key inserted in the housing part, traversing in a slot in the carrier element, or any other device providing the same function, inserted into the area between the housing portion at the front end of the gun head and the distal end of the gun barrel.

To correspond to emerging environmental demands, the invention also may be configured with provisions for evacuating vaporized fluid in a fluid tank from the area around the exit port of the gun barrel. This may be accomplished by providing an outer pipe to the fluid gun barrel, surrounding the inner fluid conduit and concentric with the inner fluid conduit, with a spacing therebetween. The spacing is then subjected to suction, via the gun head, to evacuate vapor from the region adjacent the gun barrel outlet.

To maintain the flexibility of the invention with the vapor evacuating solution present, the fluid gun may include the following features: a ball with a fluid flow conduit therethrough, where one end of the fluid flow conduit is connected to the fluid outlet of the actuating valve in the gun head, and the other end of the flow conduit opens towards the fluid conduit of the gun barrel, and a carrier element for the fluid conduit of the gun barrel. The inside of the carrier element is shaped complementary to the ball and at least partially encompasses the ball with a spacing therebetween, allowing rotative movement of the carrier element about the ball. The outside of the carrier element is shaped complementary to the inside of a terminating element of the outer tube. The carrier element for the gun barrel has a fluid flow conduit communicating with the flow conduit in the ball, and the fluid conduit of the gun barrel is connected to the outlet of the fluid flow conduit in the carrier element. The outside of the terminating element of the outer tube is shaped complementary to the inside of a housing portion of the gun head with a spacing provided between the outside of the terminating element of the outer tube and the housing portion of the gun head, allowing rotatable movement of the terminating element inside the housing part of the gun head.

The scope of the present invention will become apparent from the detailed description given below with reference to the attached drawings, as well as from the accompanying claims. However, the detailed description and specific examples, while indicating preferred embodiments of the invention, are given by way of illustration only. Various changes and modifications within the spirit and scope of the invention will become apparent to those skilled in the art from this detailed description.

BRIEF DESCRIPTION OF THE DRAWINGS

The accompanying drawings, which are incorporated in and constitute a part of the specification, illustrate embodiments of the invention, and together with the description, explain the advantages and principles of the invention.

DESCRIPTION OF THE PREFERRED EMBODIMENTS

The present preferred embodiments of the invention will now be described with reference to the accompanying drawings.

Figures 1, 1A:
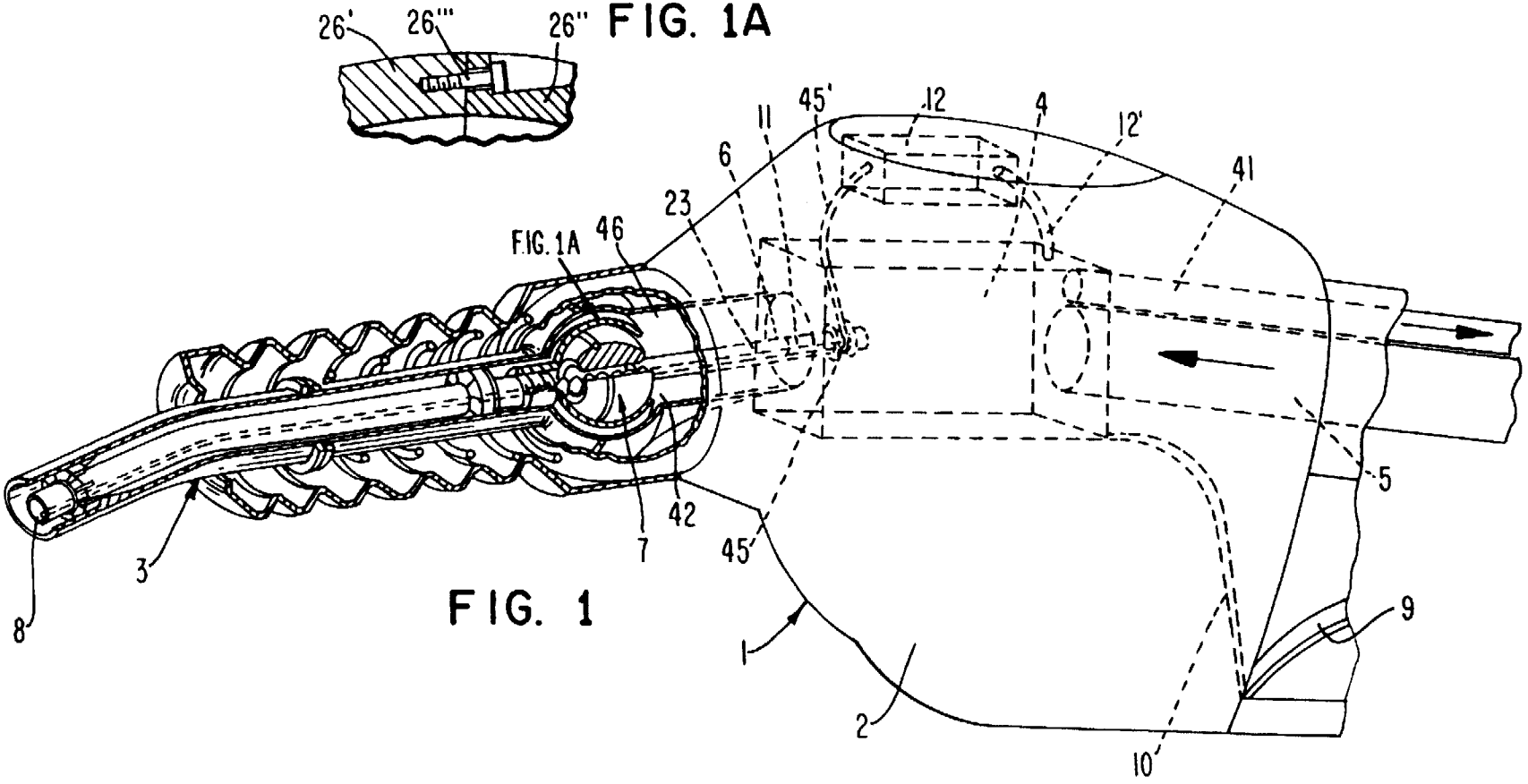
FIG. 1 is a perspective view, partially in cross-section, depicting a gun head and a gun barrel with a pivotable joint therebetween in accordance with the invention.
Figure 2A:
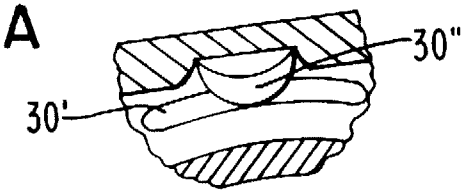
FIG. 2 is an enlarged perspective view partially in cross-section of the pivotable joint and the gun barrel of the invention.
Figure 2:
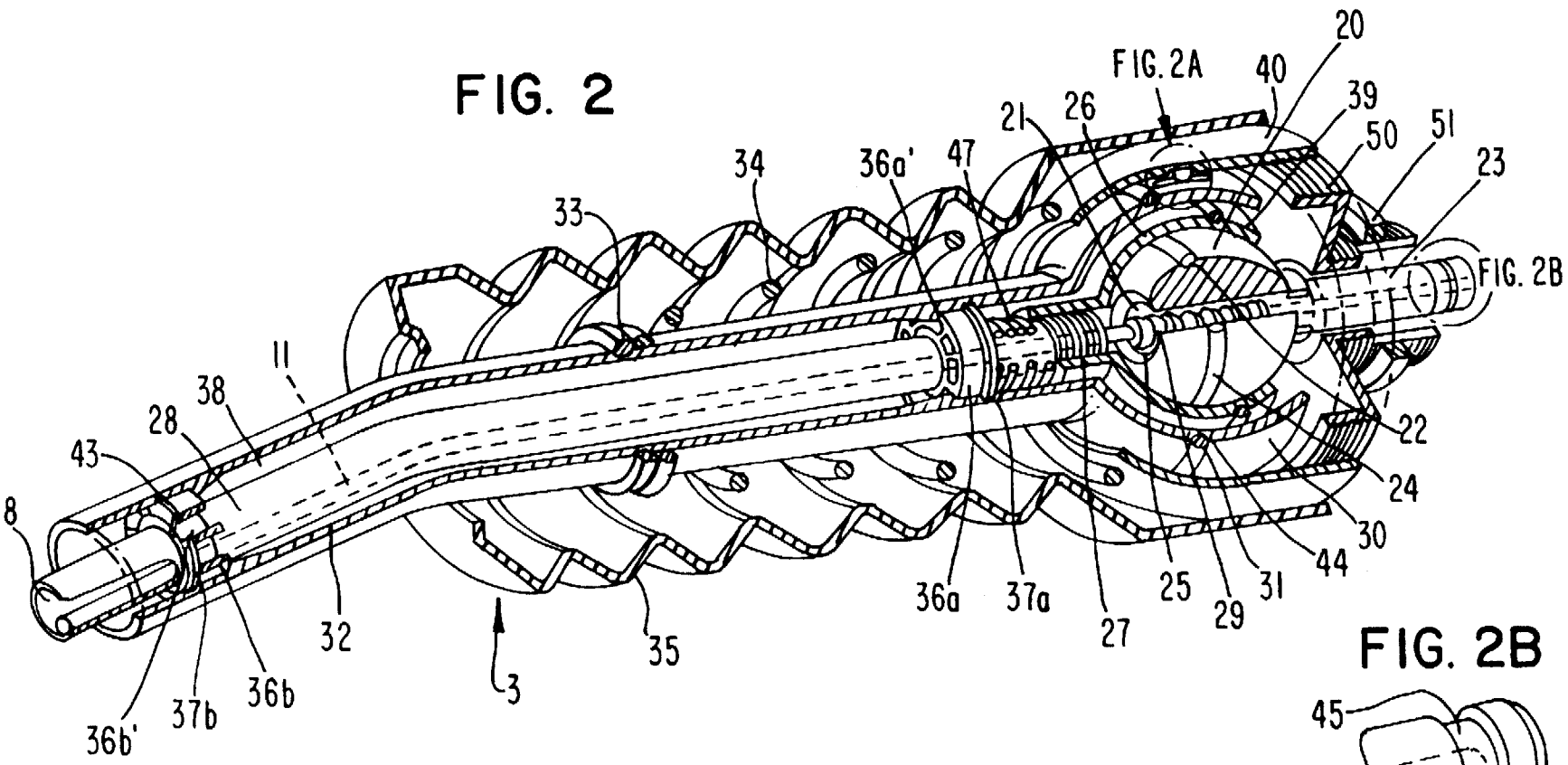
Figure 2B:
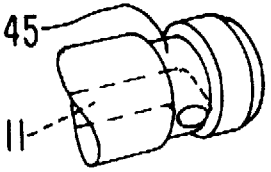

FIGS. 1 and 2 show a fluid filler gun 1, comprising two main parts, a filler gun head 2, and a gun barrel 3. The gun barrel 3 is pivotably connected to the gun head 2 by a ball joint 7. The gun head has a fluid inlet 5, and an actuating valve 4, which is connected to an operator handle 9 by a linkage 10. The actuating valve 4 is furthermore operated by a backpressure sensing element 12 connected to a backpressure sensing pipe 11, through a slot 45, a communicating passage 45' and a communicating passage 12', with the backpressure sensing pipe 11 being fitted inside a fluid flow conduit pipe 28 of the gun barrel 3. This backpressure sensing pipe 11 normally has both of its ends open. However, when the fluid tank is full, and the fluid level in the tank inlet rises up to the outlet of the gun barrel 3, then the backpressure sensing pipe 11 is closed at one end and a membrane element in back pressure sensing element 12 operative with the backpressure sensing pipe 11 via the communicating passage 45' and the slot 45, responding thereto by the communicating passage 12', causes the linkage 10 between the operator handle 9 and the actuating valve 4 to be made inoperative, and the fluid flow through the actuating valve 4 is thereby stopped.

Figure 3:
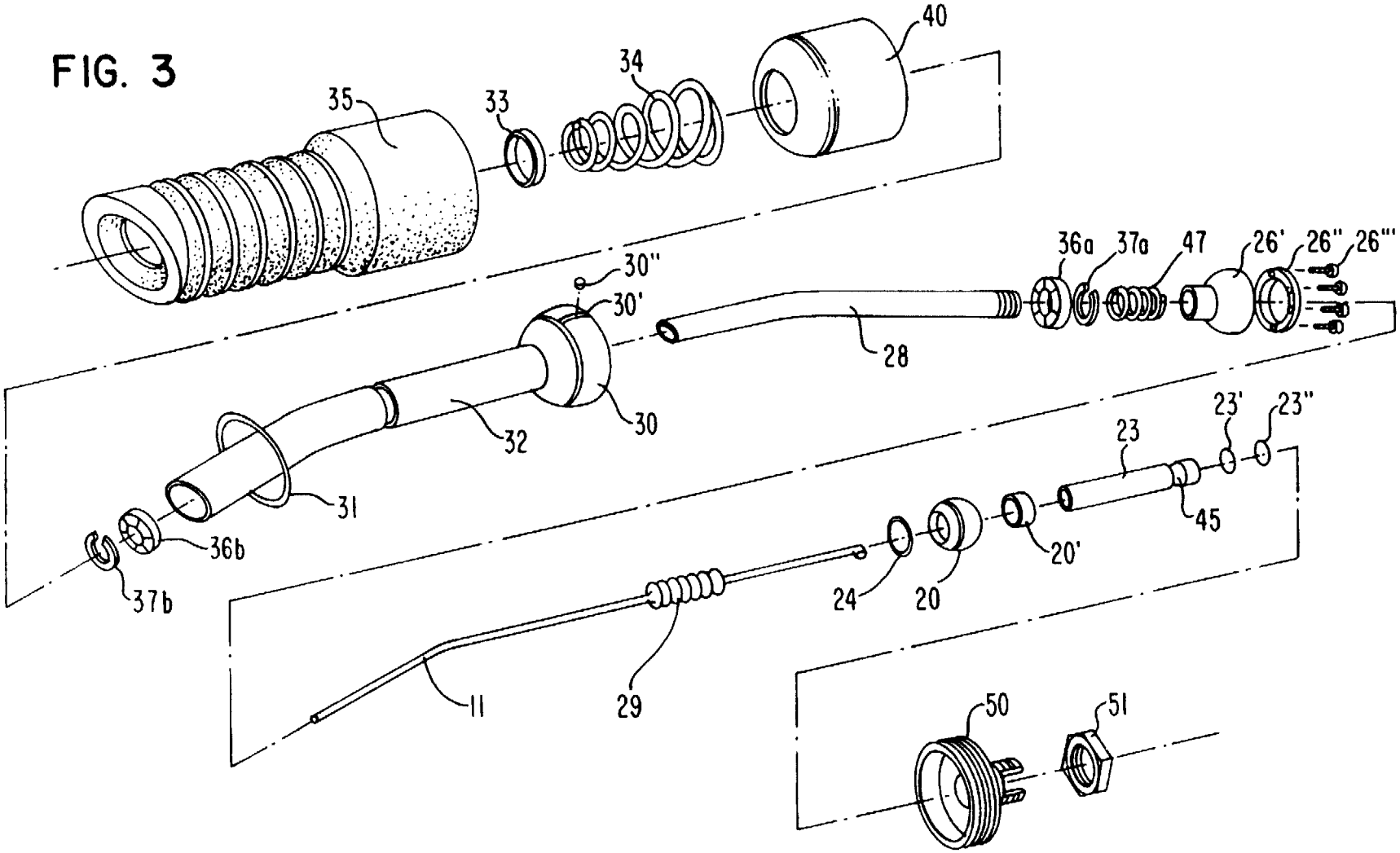
FIG. 3 is an exploded view of the parts making up the pivotable assembly of the gun barrel in accordance with the invention.

The ball joint 7, about which the gun barrel 3 is pivotable, is further shown in FIGS. 2 and 3. Ball joint 7 includes a ball 20 with a fluid flow conduit 21 therethrough, where one end of the fluid flow conduit 21 is connected to a fluid outlet 6 from the fluid actuating valve 4, through a spacer element 20' and a connecting conduit 23. The other end 25 of the fluid flow conduit 21 of the ball 20 opens towards the interior of a fluid conduit 8 of a pipe 28. This fluid conduit 8 of the pipe 28 leads fluid through the barrel 3 and into a filling tube of a fluid tank (not shown). The ball joint 7 also includes a carrier element 26 for the fluid flow conduit pipe 28 of the gun barrel 3. An interior part of the carrier element 26 is shaped substantially complementary to the ball 20 and at least partly encompasses the ball 20, defining a space 39 therebetween. The carrier element 26 and the fluid flow conduit pipe 28 attached thereto via a female/male coupling 27 can then rotate about the ball 20 with two degrees of freedom while the opening of the fluid flow conduit 25 of the ball 20 at all times is pointed directly, or at an angle, to the fluid conduit 8 of the fluid flow conduit pipe 28.

Referring to all of the drawings, the filler gun 1, when operated, allows fluid to flow through the inlet pipe or hose 5 to the actuating valve 4, out of the output opening 6 of the actuating valve 4 and through the connecting conduit 23 between the actuating valve 4 and the fluid flow conduit 21 of the ball 20, into the fluid flow conduit 21, out of the opening 25 of the fluid flow conduit 21, and into the fluid flow conduit 8 of the fluid flow conduit pipe 28 of the gun barrel 3.

To ensure that the fluid does not spill or backflow through the space 39 between the ball 20 and the carrier element 26, a sealing element 24, e.g. an O-ring, is fitted in a groove 22 on the ball 20, thereby sealing the space 39.

The backpressure sensing pipe 11 is fitted inside the fluid flow conduit pipe 28. In the transition between the fluid flow conduit pipe 28 and the fluid flow conduit 21 of the ball 20 there is a flexible bellow 29 forming a part of the backpressure sensing pipe 11, to allow movement of the fluid flow conduit pipe 28 and its carrier element 26 relative to the ball 20 without inflicting damage to the backpressure sensing pipe 11. The backpressure sensing pipe 11 then continues through the fluid flow conduit 21 of the ball 20 and completely or partially through the connecting conduit 23, through a hole in the slot 45 of the connecting conduit 23 and further through the communicating passage 45' into the backpressure sensing element 12. The backpressure sensing element 12 responds to blockage of the backpressure sensing pipe 11 at the foremost end and causes the link 10 between the handle 9 and the actuating valve 4 to be interrupted through the communicating passage 12'. The groove 45 is sealed off at both sides externally by sealing rings 23' and 23", e.g. O-rings, to maintain the pressure in the transition between the backpressure sensing pipe 11 and the communicating passage 45'.

The gun head 2 is configured at a front, inside region thereof with a housing portion 40, shaped complementary to the carrier element 26. Housing portion 40 of gun head 2 has an opening in the front which is large enough to allow the gun barrel 3 to move relative to the gun head 2 while it pivots about the ball 20.

Preferably, to enable the carrier element 26 to encompass more than half of the surface of the ball 20, the carrier element 26 can be split in two parts 26' and 26", as shown in the enlarged portion of FIG. 1, where the two parts 26' and 26" are interconnected e.g. by bolts 26'".

The filler gun 1 also may have provisions for evacuating fluid vapors emerging from the filling pipe of the fluid tank. This feature is illustrated in the drawings by the use of a second pipe 32 surrounding the fluid conduit pipe 28 of the gun barrel 3, leaving a spacing 38 therebetween. This spacing 38 is subjected to suction at the rear end of the gun barrel 3, and vapors appearing in the region of the outlet of the gun barrel 3 are drawn into the spacing 38 and are further processed or returned to a supply tank (not shown) via the gun head 2 and a fluid vapor return line 41. The vapors may be gathered and directed by the leading end 46, or may be processed through the gun head by other provisions for leading the escaped vaporized fluid to the fluid vapor return line 41.

As can be seen in the drawings, the outer pipe 32 is arranged so as to surround the fluid conduit pipe 28 of the gun barrel 3. The outer pipe 32 is held in position by spacer elements 36*a* and 36*b*. The spacer elements 36*a*, 36*b* can be held in position by means of locker rings 37*a*, 37*b* which fit into narrow recesses, e.g. 43, on the interior of the outer pipe 32. These spacer elements 36*a* and 36*b* have openings 36'*a* and 36'*b*, which allow vapor to pass through the spacing 38 between the fluid conduit pipe 11 and the outer tube 32. The outer tube 32 furthermore connects with or has a terminating element 30 at the end closest to the ball joint 7. This terminating element 30 has an interior surface that is shaped complementary to the carrier element 26 of the inner pipe 28, allowing the terminating element 30 and the connected outer pipe 32 to rotate together with the carrier element 26 and its connected inner pipe 28 about the ball 20, within the housing portion 40 of the gun head 2. To ensure that the vapor does not evacuate into the environment through the gap 42 between the terminating element 30 and the housing part 40, there is provided a seal 31, e.g., an O-ring, which fits into a recess 44 on the terminating element 30. The gun barrel 3 is surrounded by a helical spring 34 which at one end is held in position by a lock clip 33 engaging the exterior of the fluid conduit pipe 32 of the gun barrel 3. The opposite end of the helical spring 34 rests against the exterior surface of the housing 40 of the gun head 2. This makes the gun barrel autoalignable as it will return to a neutral position by the forces exerted onto the gun barrel 3 by the helical spring 34. The gun barrel 3 and helical spring 34 are furthermore partly or completely encompassed by a flexible bellow 35.

The terminating element 30 leads the vapor into the fluid vapor return line 41 for processing or distributing the vapor.

The pivoting movement of the gun barrel may be limited to avoid excessive pivotable movement, such as twisting the gun barrel, by providing a key 30" in the housing 40 traversing in a slot 30' in the terminating element 30. The limits may be set by the length and position of the slot 30'. The key 30" may, in an embodiment without the outer pipe 32, be placed in the housing element 40, traversing in a slot in the carrier element 26.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fluid filler gun comprising:

a gun handle;

a gun head having a first end connected to said gun handle, said gun head housing an actuating valve;

a gun barrel surrounding a first fluid conduit; and a ball joint apparatus pivotally connecting said gun barrel to a second end of said gun head, said ball joint apparatus including a second fluid conduit in communication between the first fluid conduit and an outlet of the actuating valve.

2. The fluid filler gun of claim 1, wherein said ball joint apparatus includes a ball having the second fluid conduit defined therethrough, and a carrier element having an internal surface shaped generally complementary to said ball and at least partially encompassing a surface of said ball, defining a space therebetween and allowing rotation of said carrier element relative to said ball, said carrier element further having an external surface shaped generally complementary to an interior portion of the second end of said gun head, and said carrier element further including a third fluid conduit in communication between the first and second fluid conduits.

3. The fluid filler gun of claim 2, wherein said carrier element includes at least two interconnectable parts.

4. The fluid filler gun of claim 2, wherein the internal surface of said carrier element encompasses over half of the surface of said ball, thereby interlocking said carrier element and said ball.

5. The fluid filler gun of claim 2, further comprising a seal provided in the space between said carrier element and said ball.

6. The fluid filler gun of claim 2, further comprising a restrictive element provided between said carrier element and the interior portion of the second end of said gun head for limiting pivotable movement of said barrel.

7. The fluid filler gun of claim 6, wherein said restrictive element includes a key provided in the interior portion of said gun head traversable in a slot provided in said carrier element.

8. The fluid filler gun of claim 2, further comprising a backpressure sensing element in said gun head, and a backpressure sensing passage extending between said backpressure sensing element and the first fluid conduit.

9. The fluid filler gun of claim 2, further comprising a helical spring coaxially mounted on said gun barrel for autoaligning said gun barrel with said gun head.

10. The fluid filler gun of claim 9, wherein said helical spring engages an outlet of said gun barrel with a lock clip and extends to the connection with said gun head.

11. The fluid filler gun of claim 10, further comprising a flexible bellow surrounding said helical spring.

12. A fluid filler gun comprising:

a gun handle;

a gun head having a first end connected to said gun handle, said gun head housing an actuating valve;

a gun barrel including an inner tube and an outer tube concentrically surrounding said inner tube, said inner tube defining a first fluid conduit; and a ball joint apparatus pivotally connecting said gun barrel to a second end of said gun head, said ball joint apparatus including a second fluid conduit in communication between the first fluid conduit and an outlet of the actuating valve.

13. The fluid filler gun of claim 12, wherein said inner tube and said outer tube of said gun barrel are held in concentric position relative to one another by a spacer element defining a space between said inner tube and said outer tube.

14. The fluid filler gun of claim 13, wherein said inner and outer tubes have two ends, and a spacer element is positioned proximate each end.

15. The fluid filler gun of claim 13, wherein said spacer element includes an opening to allow fluid flow through said space and said spacer element.

16. The fluid filler gun of claim 13, wherein said space between said inner and outer tubes is subjected to suction to evacuate vapor from a region adjacent an outlet of said gun barrel.

17. The fluid filler gun of claim 12, wherein said ball joint apparatus includes a ball having the second fluid conduit defined therethrough, and a carrier element having an internal surface shaped generally complementary to said ball and at least partially encompassing a surface of said ball, defining a space therebetween and allowing rotation of said carrier element relative to said ball, said carrier element further having an external surface shaped generally complementary to an interior of a terminating element of the outer tube of said gun barrel, said carrier element further including a third fluid conduit in communication between the first and second fluid conduits, and said terminating element further having an outer surface shaped generally complementary to an interior portion of the second end of said gun head with a spacing therebetween to allow rotation of said terminating element relative to the second end of said gun head.

18. The fluid filler gun of claim 17, wherein said carrier element includes at least two interconnectable parts.

19. The fluid filler gun of claim 17, wherein the internal surface of said carrier element encompasses over half the surface of said ball, thereby interlocking said carrier element and said ball.

20. The fluid filler gun of claim 17, further comprising a seal provided in the space between said carrier element and said ball.

21. The fluid filler gun of claim 17, further comprising a restrictive element provided between said carrier element and the interior portion of the second end of said gun head for limiting pivotable movement of said barrel.

22. The fluid filler gun of claim 17, wherein said restrictive element includes a key provided in the interior portion of said gun head traversable in a slot provided in said carrier element.

23. The fluid filler gun of claim 17, wherein a sealing element is located in the spacing between the terminating element of said outer tube and the interior of the second end of said gun head.

24. The fluid filler gun of claim 17, further comprising a backpressure sensing element in said gun head, and a backpressure sensing passage extending between said backpressure sensing element and the first fluid conduit.

25. The fluid filler gun of claim 17, further comprising a helical spring coaxially mounted on said gun barrel for autoaligning said gun barrel with said gun head.

26. The fluid filler gun of claim 25, wherein said helical spring engages an outlet of said gun barrel with a lock clip and extends to the connection with said gun head.

27. The fluid filler gun of claim 26, further comprising a flexible bellow surrounding said helical spring.

28. A fluid filler gun comprising:

a gun handle;

a gun head having a first end connected to said gun handle, said gun head housing an activating valve;

a gun barrel connected to a second end of said gun head including an inner tube and an outer tube concentrically surrounding said inner tube, said inner tube defining a fluid conduit in fluid communication with an outlet of said actuating valve, and said outer tube being subjected to suction to evacuate vapor from a region adjacent an outlet of said gun barrel; and a ball joint apparatus pivotably connecting said gun barrel to the second end of said gun head.

29. The fluid filler gun of claim 28, wherein said ball joint apparatus includes a conduit in fluid communication between the outlet of said actuating valve and the conduit defined by the inner tube of said gun barrel.

* * * * *